US007959708B2

(12) United States Patent
Mahoney et al.

(10) Patent No.: US 7,959,708 B2
(45) Date of Patent: Jun. 14, 2011

(54) INJECTION METHOD FOR INERT GAS

(75) Inventors: William John Mahoney, E. Aurora, NY (US); Gary Thomas Vardian, Indian Trail, NC (US)

(73) Assignee: Praxair Technology, Inc., Danbury, CT (US)

( * ) Notice: Subject to any disclaimer, the term of this patent is extended or adjusted under 35 U.S.C. 154(b) by 0 days.

(21) Appl. No.: 12/517,617

(22) PCT Filed: Dec. 14, 2007

(86) PCT No.: PCT/US2007/087607

§ 371 (c)(1),
(2), (4) Date: Sep. 25, 2009

(87) PCT Pub. No.: WO2008/076901

PCT Pub. Date: Jun. 26, 2008

(65) Prior Publication Data

US 2010/0044930 A1 Feb. 25, 2010

Related U.S. Application Data

(60) Provisional application No. 60/875,112, filed on Dec. 15, 2006.

(51) Int. Cl.
*C22B 9/05* (2006.01)

(52) U.S. Cl. ..... 75/528; 75/529; 75/530; 266/47; 266/225; 266/267

(58) Field of Classification Search ..... 75/528–530; 266/47, 225, 267

See application file for complete search history.

(56) References Cited

U.S. PATENT DOCUMENTS

| | | | |
|---|---|---|---|
| 3,427,151 | A | 2/1969 | Koudelka et al. |
| 4,149,878 | A | 4/1979 | Thokar et al. |
| 4,210,442 | A | 7/1980 | Lewis, III et al. |
| 4,397,685 | A | 8/1983 | Maddever et al. |
| 4,622,007 | A | 11/1986 | Gitman |
| 5,413,623 | A | 5/1995 | Oonuki et al. |
| 5,599,375 | A | 2/1997 | Gitman |
| 5,788,921 | A | 8/1998 | Gitman et al. |
| 5,814,125 | A | 9/1998 | Anderson et al. |
| 5,927,960 | A | 7/1999 | Felderman |
| 5,931,985 | A | 8/1999 | Schoeler et al. |

(Continued)

FOREIGN PATENT DOCUMENTS

| | | |
|---|---|---|
| GB | 1371978 | 10/1974 |

(Continued)

OTHER PUBLICATIONS

Koria, S.C., "Principles and applications of gas injection in steelmaking practice", Scandinavian Journal of Metallurgy, Munksgaard, Copenhagen, DK, vol. 22, No. 5, Oct. 1993, pp. 271-279, XP000998124.

*Primary Examiner* — George Wyszomierski
*Assistant Examiner* — Tima M McGuthry-Banks
(74) *Attorney, Agent, or Firm* — Donald T. Black

(57) ABSTRACT

A method and apparatus for forming internally shrouded supersonic coherent jets comprising an inert gas, such as pure argon and argon/oxygen mixtures. This method and apparatus can be employed to produce low-carbon steels with a top lance in basic oxygen steelmaking.

10 Claims, 14 Drawing Sheets

1st CONE = POTENTIAL CORE

2nd CONE = SUPERSONIC CORE

U.S. PATENT DOCUMENTS

| | | | | |
|---|---|---|---|---|
| 5,944,507 | A | 8/1999 | Feldermann | |
| 6,096,261 | A | 8/2000 | Anderson et al. | |
| 6,125,133 | A | 9/2000 | Mathur et al. | |
| 6,142,764 | A | 11/2000 | Anderson et al. | |
| 6,171,544 | B1 | 1/2001 | Anderson et al. | |
| 6,176,894 | B1 | 1/2001 | Anderson et al. | |
| 6,261,338 | B1 | 7/2001 | Mahoney et al. | |
| 6,322,610 | B1 | 11/2001 | Pavlicevic et al. | |
| 6,383,445 | B1 * | 5/2002 | Anderson et al. | 266/225 |
| 6,450,799 | B1 | 9/2002 | Mahoney et al. | |
| 6,514,310 | B2 | 2/2003 | Allemand et al. | |
| 6,604,937 | B1 | 8/2003 | Mahoney | |
| 6,773,484 | B2 | 8/2004 | Mahoney et al. | |
| 6,932,854 | B2 | 8/2005 | Riley et al. | |
| 7,452,401 | B2 * | 11/2008 | Mahoney et al. | 75/528 |

FOREIGN PATENT DOCUMENTS

| | | |
|---|---|---|
| JP | 08-075364 | 3/1996 |
| JP | 10-009524 | 1/1998 |
| JP | 10-030110 | 2/1998 |
| JP | 10-259413 | 9/1998 |
| JP | P2002-288115 | 9/2002 |
| JP | P2003-324856 | 9/2003 |
| WO | WO 2008076901 A1 | 6/2008 |

* cited by examiner

1st CONE = POTENTIAL CORE

2nd CONE = SUPERSONIC CORE

INJECTION METHOD FOR INERT GAS

CROSS-REFERENCE TO RELATED APPLICATION

The present invention claims priority to U.S. provisional patent application Ser. No. 60/875,112 filed Dec. 15, 2006, and International Patent Application No. PCT/US2007/087607, filed on Dec. 14, 2007, the contents of which are incorporated herein by reference in its entirety.

TECHNICAL FIELD

The present invention generally relates to a method of injecting a supersonic coherent jet of an inert gas (either a pure inert gas or a high concentration of inert gas) into a molten metal bath located within a metallurgical furnace.

BACKGROUND OF THE INVENTION

In steelmaking, it is desirable to form coherent jets to promote mixing of the molten steel and to dilute the carbon monoxide (CO) in the molten steel and encourage the carbon and oxygen to come out of the steel. However, the use of oxygen to form such coherent jets can result in oxidation of the steel and undesirable by-products. Thus, it would be useful to form coherent jets from inert gases that do not react with the steel. The most desirable inert gas is argon because it is truly inert. Argon does not react at all with steel. Other inert gases are also desirable, but may have some reaction with steel. For example, nitrogen may cause "nitrogen pickup" and add nitrogen into the steel, affecting the quality of the steel. Another inert gas such as carbon dioxide may oxidize the molten steel bath due to the dissociation of CO2.

In general, the prior art teaches utilizing the "external shroud" technique, whereby the main jets, including an inert gas, are surrounded by an externally produced flame shroud. U.S. Pat. No. 7,452,401 and entitled "Oxygen Injection Method" (Mahoney et al.), discloses the "internal shroud" method to form oxygen coherent jets for application to improving the top-blown refining process of molten metal baths (e.g., basic oxygen furnace (BOF) steelmaking).

The internal shroud technique described by Mahoney et al. incorporates the following elements:

1. production of a supersonic oxygen stream in a converging-diverging nozzle;
2. blending hydrogen-containing fuel into the perimeter of the oxygen, upstream of the nozzle exit;
3. exhausting the combined supersonic stream as a jet into a furnace for example a basic oxygen furnace at high temperature; and
4. combusting the injected fuel and oxygen in the shear (or mixing) layer to produce a coherent jet.

A problem arises when this method is applied to pure inert gas or high concentration inert gas, balance oxygen. The internal shroud method is ineffective for producing coherent jets of inert gases due to the elimination or suppression of fuel combustion in the jet shear layer (i.e., combusting the injected fuel and oxygen in the shear layer to produce a coherent jet is not possible).

Therefore, a problem to solve is the production of coherent jets containing pure or a high concentration of inert gas, particularly argon, using the internal shroud technique. Another problem to solve is the improvement of the refining of molten metal, particularly the basic oxygen process, by the application of internal shroud coherent jets containing argon.

Japanese Patent Application No. JP2002-288115 (JFE/Nippon) is concerned with the process of flame stabilization within a duct. This is accomplished by injecting fuel, which mixes with a portion of the main oxygen stream. Upon ignition, the flame is stabilized within an annular groove located in the gas passage wall, which acts as a flame holder. As a result, this technique cannot be applied to produce argon coherent jets. Japanese Patent Application No. JP2003-0324856 discloses a single burner lance capable of supplying flame and an oxygen jet to a wide area in melting/refining of iron, but does not discuss injection of an inert gas or an internal shroud.

Because of the difficulties in applying an internal shroud method to an inert gas, it has not been achieved thus far. The present invention allows the relative advantages of the internal shroud method versus the external shroud method to now be applied to inert gases such as argon.

SUMMARY OF THE INVENTION

The present invention relates to a method of injecting a supersonic coherent jet of an inert gas into a melt located within a metallurgical furnace having a heated furnace atmosphere.

In accordance with the method, an inert gas stream is introduced into a nozzle having a passageway of a converging-diverging configuration. It is to be noted that the entire passageway does not have to have a converging-diverging configuration and in fact, a passageway in accordance with the present invention can have a converging-diverging configuration portion followed by a straight cylindrical portion extending to the face of the nozzle. Further more, the term "inert gas stream", as used herein and in the claims, encompasses uniformly blended streams having an inert gas concentration of at least 40% by volume, and preferably at least 70% by volume. An oxygen stream is injected into the inert gas stream at inner circumferential locations of the passageway that are situated entirely within the passageway so that a combined inert gas and oxygen containing stream is formed within the passageway. In this regard, "oxygen stream" means a stream having an oxygen concentration of at least 75% by volume and preferably commercially pure oxygen at least 90% by volume. Then a fuel containing a hydrogen species is injected into the inert gas stream at inner circumferential locations of the passageway that are situated entirely within the passageway. In this regard, the term "hydrogen species" means molecular hydrogen or a molecule containing hydrogen or any substance containing hydrogen atoms or combinations thereof. As a result, a combined fuel, inert gas and oxygen stream is formed within the passageway having a structure composed of an outer circumferential region, comprising a mixture of the fuel, inert gas and oxygen, and an inner central (core) region that is surrounded by the outer circumferential region and containing the combined inert gas and oxygen and essentially no fuel.

The inert gas stream is introduced into an inlet section of the passageway at or above a critical pressure. As a result, a choked flow condition is established within a central throat section of the passageway, the combined fuel, inert gas and oxygen containing stream is accelerated to a supersonic velocity within a diverging section of the passageway, and the combined fuel, inert gas and oxygen containing stream is discharged as a structured jet from the nozzle into the furnace atmosphere. The structured jet has the structure of the combined fuel, inert gas and oxygen containing stream and the supersonic velocity upon discharge from the nozzle.

Ignition and combustion of the fuel while within the passageway is prevented by not introducing an ignition source and providing the passageway with an inner surface uninterrupted by any discontinuity within which the outer circumferential region could otherwise decelerate and provide a site for stable combustion of the fuel.

A flame envelope is produced that surrounds a jet of inert gas formed from the inner central region of the structured jet and that initially has the supersonic velocity. The flame envelope inhibits velocity decay and concentration decay of the jet of inert gas. Velocity would otherwise decay without the flame envelope due to interaction of the jet of inert gas with the furnace atmosphere. Such interaction also causes a dilution of the jet of inert gas to produce a concentration decay. As used herein and in the claims, the term "flame envelope" means a flame that surrounds the jet of inert gas and propagates along the length thereof by active combustion of the fuel and any reactants that may be present within the heated furnace atmosphere, wherein such combustion is supported in whole or in part by oxygen supplied by the structured jet of inert gas. In the present invention, the flame envelope is produced entirely outside of the nozzle through contact of the outer circumferential region of the structured jet with the heated furnace atmosphere. This contact creates a shear-mixing zone containing a flammable mixture composed of the fuel, the argon, the oxygen and the heated furnace atmosphere and auto-ignition of the flammable mixture through heat supplied by the heated furnace atmosphere.

The jet of inert gas is directed into the melt, while surrounded by the flame envelope. In this regard, the term "melt" as used herein and in the claims with respect to a steelmaking furnace, electric arc furnace (EAF) or BOF, means both the slag layer and the underlying molten pool of metal. As a result, in such furnace, the jet of inert gas would first enter the slag layer. In case of a metallurgic furnace in which a slag layer is not produced, the "melt" at which the jet of inert gas enters would constitute the molten metal. An example of this would be a non-ferrous refining vessel.

Although not known in the prior art, a discharge of a structured jet, such as described above, when contacted by the heated furnace atmosphere will produce a region within an outer shear-mixing zone that will ignite to form a flame envelope that will surround and inhibit velocity decay and concentration decay of a supersonic jet of inert gas formed by the inner central region of the structured jet. This allows a nozzle of the present invention to be positioned at some distance away from the melt and allows the beneficial stirring action of the melt to be enhanced.

As indicated above and as known in the prior art, the production and injection of a jet of inert gas while at a supersonic velocity has the advantage of minimizing any oxidization of the metal contained within the melt for refining purposes while at the same time producing a vigorous stirring action of the melt. Additionally, there are no external fuel passages that can plug requiring removal of the lance from service and extraction of deposits, known as skull, from the face of the nozzle. Furthermore, as can be appreciated from the above discussion, the disadvantages of mixing, igniting, stabilizing and combusting an oxygen and fuel containing stream at high velocity within a combined space (nozzle) are avoided by the present invention because ignition, stabilization and combustion of the mixture of fuel and oxygen is prevented while within the nozzle.

The combined fuel, inert gas and oxygen containing stream can be fully expanded upon discharge thereof as the structured jet from the nozzle. The fuel can be introduced to inert gas and oxygen containing stream while within the diverging section of the nozzle. As a safety measure, the combined fuel, inert gas and oxygen containing stream can be over expanded upon the discharge thereof as the structured jet from the nozzle such that the stream has a sub-ambient pressure while within the diverging section of the nozzle. The fuel can be introduced into the inert gas and oxygen containing stream at a location within the diverging section at which the inert gas and oxygen containing stream is at the sub-ambient pressure. As a result, upon failure of the fuel supply system, inert gas and oxygen will not back-flow through fuel passages creating a potentially dangerous condition. Another beneficial result is the fuel delivery system is not required to overcome positive back-pressure in the nozzle, thereby minimizing the supply pressure required for fuel delivery into the nozzle.

The diverging section of the nozzle can extend from the central throat section to a nozzle face of the nozzle exposed to the heated furnace atmosphere. Other possibilities will become apparent from the detailed discussion below.

Preferably, the supersonic velocity of the structured jet of combined fuel, inert gas and oxygen is at least about Mach 1.7.

The metallurgical furnace can be an electric arc furnace (EAF).

Alternatively, the metallurgical furnace can be a basic oxygen furnace (BOF). In such cases, the fuel is preferably introduced into the oxygen stream at a specific equivalence ratio. The equivalence ratio between the shroud fuel (F) and oxygen (O) is defined as the ratio of the fuel/oxygen ratio to the stoichiometric fuel/oxygen ratio:

$$(F/O)/(F/O)_{stoich.} \quad \text{(Equation 1)}$$

For example, a shroud composed of $CH_4$ and $O_2$, the $F/O_{stoich}=0.5$. For pure argon, experiments indicate that the shroud requirement would be about F/O=0.2 to 0.13 (very oxidizing). Thus, the equivalence ratio would be between 0.26 to 0.4. However, the invention would still be operable outside of these ranges so these are preferred, but not required. For pure argon, it would be preferable to inject about 5-15% oxygen of the argon as shroud oxygen and less would be required for argon/oxygen ignition jets.

In either type of furnace, the heated furnace atmosphere will contain carbon monoxide and the flammable mixture used in forming the flame envelope will in turn contain the carbon monoxide. Where the metallurgical furnace is a basic oxygen furnace, the nozzle can be mounted in a water-cooled lance at a lance tip of the water-cooled lance. It is understood, however, that the application of the present invention is not limited to such furnaces and in fact can be used in a furnace having a heated furnace atmosphere that contains no carbon monoxide or any other substance that can serve as part of the flammable mixture used in forming the flame envelope. All that is necessary with respect to the "heated furnace atmosphere" is that it be of sufficient temperature to cause auto-ignition of the flammable mixture.

In any embodiment of the present invention, the fuel can be introduced into the inert gas and oxygen containing stream at the inner circumferential locations of the passageway by injecting the fuel into a porous metal annular element having an inner annular surface. The inner annular surface forms part of the throat section or the diverging section of the converging-diverging passageway. (The shroud fuel and shroud oxygen can be injected together into the inert gas or can be injected separately)

In a further aspect of a method of the present invention applied to injecting inert gas into melt located within a metallurgical furnace having a heated furnace atmosphere containing carbon monoxide, inert gas streams can be introduced into nozzles having passageways of converging-diverging configuration wherein the nozzles are situated at a tip of a water-cooled lance and angled outwardly from a central axis of the water-cooled lance. Such a metallurgical furnace can be a basic oxygen furnace. The fuel containing a hydrogen species and an oxygen stream are injected into the inert gas streams in the manner outlined above to form structured jets, flame envelopes and individual jets of inert gas, which initially have a supersonic velocity. The water-cooled lance can be situated within the basic oxygen furnace and the jets of inert gas are directed into the melt.

In basic oxygen furnace lances, there are typically between 3 and 6 nozzles and the nozzles are outwardly angled at between about 6 degrees and about 20 degrees from the central axis. As indicated above, in case of a basic oxygen furnace, the fuel can be introduced into the oxygen streams at an equivalence ratio of between 0.26 and 0.4 (although not required) and the supersonic velocity of each of the structured jets of combined fuel, inert gas and oxygen can be at least about Mach 1.7. In a specific embodiment, the fuel can be introduced into a fuel chamber and the nozzles are positioned to pass through the fuel chamber. The fuel is introduced into the passageways through fuel passages located within the lance tip and communicating between the inner circumferential locations of the passageways and the fuel chamber. In this regard, there can be between about 4 and about 12 fuel passages for each of the passageways. It is to be noted that more or less fuel passages can be used. The same can be said here for the internal shroud oxygen, i.e., both fuel and oxygen can be injected into the same chamber or separate chambers.

BRIEF DESCRIPTION OF THE DRAWINGS

While the specification concludes with claims distinctly pointing out the subject matter that Applicants regard as their invention, it is believed that the invention will be better understood when taken in connection with the accompanying drawings.

DETAILED DESCRIPTION

Figure 1B:
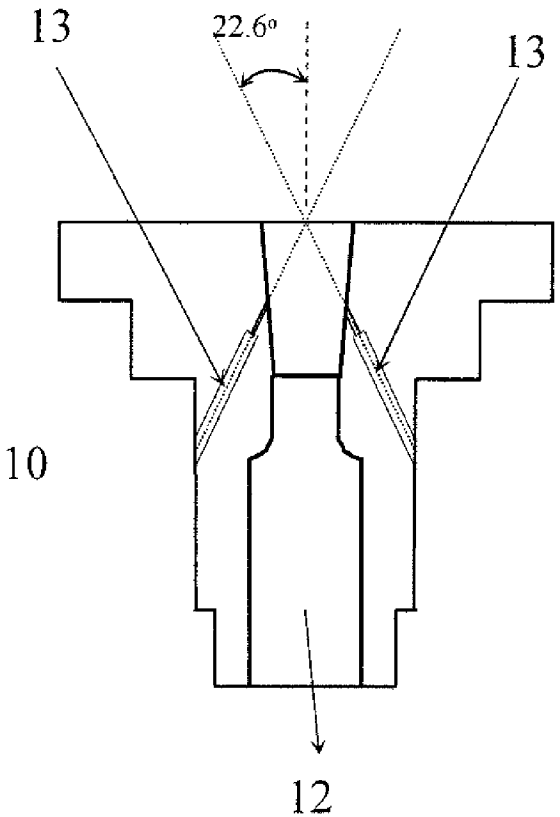
FIGS. 1(*a*) and 1(*b*) are schematics of an injector used to inject a jet of inert gas at a supersonic velocity into a melt for use in accordance with the method of the present invention, viewed from the injector face and cross-sectionally, respectively.

The problem of producing internal shroud inert gas coherent jets, in particular, argon coherent jets, is solved by the method of the present invention by introducing a mixture of fuel and oxygen into the outer periphery of the inert gas jet. The resultant supersonic "structured jet" is composed of a central region of argon gas and is surrounded by an outer circumferential region composed of argon, fuel and oxygen gas. The technique effectively transforms the surface of the argon jet into an oxygen-like jet, thereby rendering the internal fuel injection effective for producing a coherent jet of argon.

The furnace atmosphere contacts the jet through the formation of a shear (mixing) layer and activates combustion between the fuel and oxygen and results in the production of an argon coherent jet.

Relative to the external shroud, the primary advantages of positioning the fuel and oxygen injectors within the nozzle (i.e., internal shroud) include one or more of the following:

1. Eliminate plugging of the shroud gas ports. Because the ports are located within the high flow main nozzles, the propensity for plugging is very small.
2. For the BOF external shroud coherent jet lance, there is a very strong dependence of the coherent jet length versus the main nozzle divergence angle (with respect to the lance axis). Locating the injectors within the main nozzle effectively renders the coherent jet length independent of main nozzle angle.
3. For the BOF external shroud coherent jet lance, there is a strong dependence of tip and lance skull (accretion) formation on the external shroud fuel rate. That is, the skull growth rate and composition are dependent on the external fuel rate. It is believed the external fuel injection acts as a coolant (via fuel cracking) which tends to solidify slag and metal on the tip and also as a reducing agent (reducing FeO on tip to Fe). As a result, the skulls are larger and more metallic when compared to normal BOF lance skulls. Such a condition leads to more frequent and more difficult skull removal, which increases costs by increased labor and reduced tip life. Locating the injectors within the main nozzle will eliminate the contribution of fuel cracking and reduction on tip skulls by eliminating the injection of pure fuel into the furnace.
4. For the BOF external shroud coherent jet lance, such skulls can interfere with the process of coherent jet formation by interfering with the process of forming a flame shroud. This can result in variation and overall reduction of the anticipated coherent jet benefits, or may render the process of forming a coherent jet impossible.
5. There will be an improvement to top lance inert gas blowing with internal shroud coherent jet.

The internal shroud method of the present invention is an enabling technology for applying the coherent jet principle to the BOF converter, which will provide process benefits coupled with a more practical lance design.

An improved inert gas coherent jet, particularly an argon coherent jet, should enable more steelmaking benefits per volume of inert gas supplied and therefore, possibly render the top lance argon blowing process economical for BOF.

The internal shroud inert gas coherent jet apparatus incorporates the following elements:

1. An injector or lance with lance body and lance tip;
2. A means for introducing argon, oxygen and hydrogen containing fuel into the lance body;
3. A tip containing one or more converging-diverging nozzles for the production of a supersonic argon stream(s);
4. A means for injecting oxygen into the outer perimeter of the argon streams, either into the diverging section or any other section of the nozzle;
5. A means for injecting hydrogen-containing fuel into the outer perimeter of the argon stream, preferably into the diverging section of the nozzle.

Figure 2:
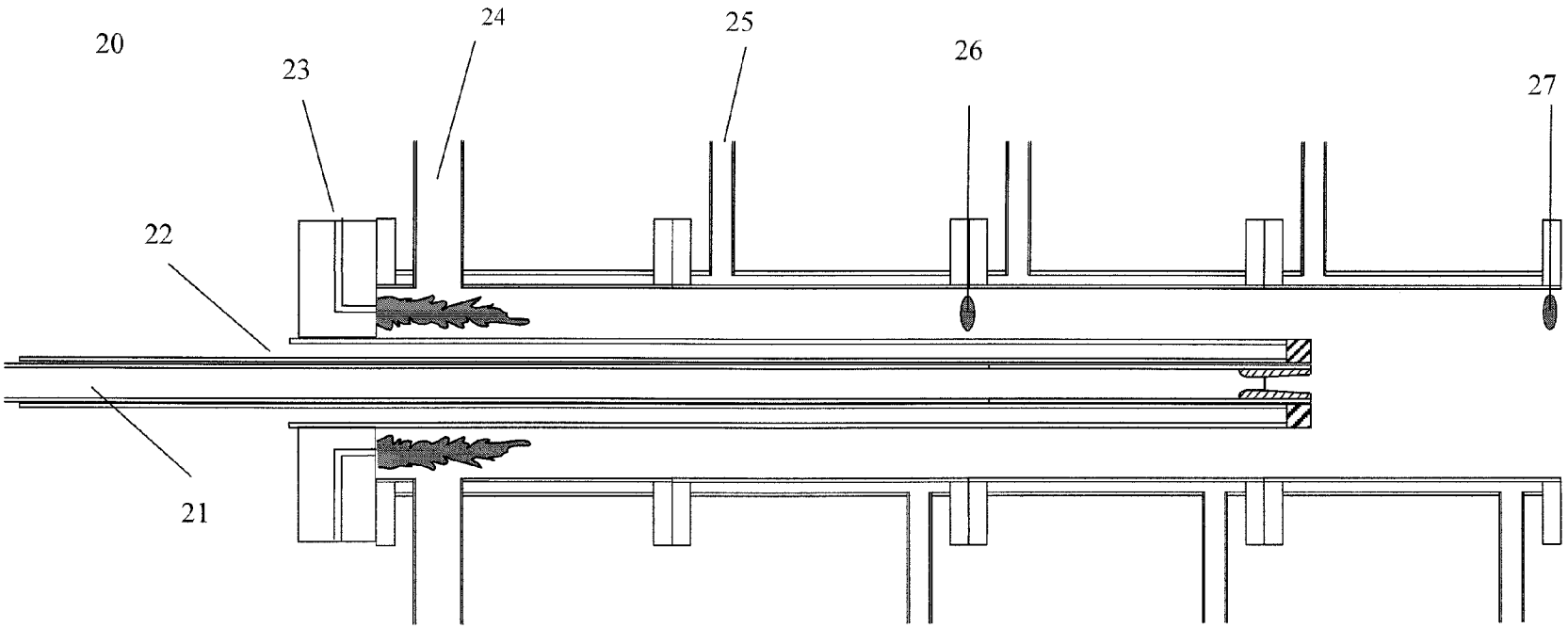
FIG. 2 is a schematic, cross-sectional view of the apparatus used to simulate the hot furnace gas.

Experiments were conducted in an apparatus used to simulate the hot furnace gas. The apparatus used in Examples 1 and 2 is shown in FIG. 2. The hot furnace gas is interacted co-axially with the internal shroud coherent jet nozzles. The apparatus (20) comprises a passageway (21) for the main inert gas flow contained in a water-cooled sheath (22). The preheat burner (23) provides CO and $O_2$ (indicated as P.H. CO and P.H. $O_2$). Additional CO flow is introduced through co-axial passageway (24). Water is introduced into the water-cooled sheath through passageway (25). A first thermocouple is placed at the mid-point (26) (T.C. Mid) of the main passageway and a second thermocouple is placed at the exit (27) (T.C. Exit) of the main passageway.

EXAMPLE 1

Argon Coherent Jets with Fuel

Figure 1A:
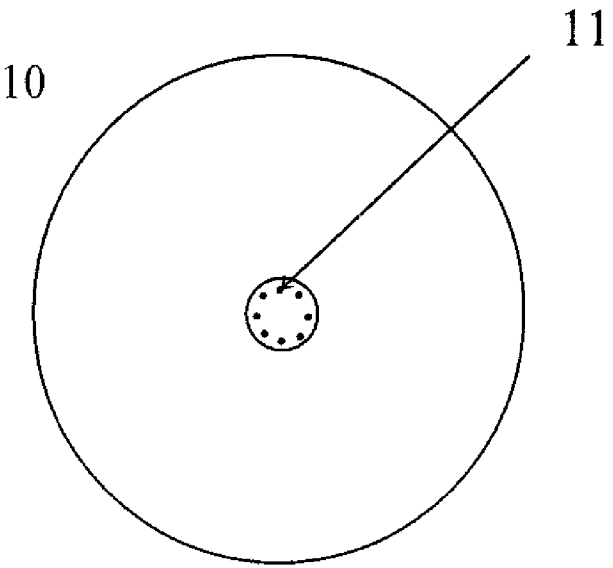

Experiments were conducted to try to produce a pure argon coherent jet injecting only internal shroud fuel. The internal shroud inert gas coherent jet injector used is illustrated in FIGS. 1(*a*) and 1(*b*). FIG. 1(*a*) is a view of the outlet of the injector (10) having eight ports (11), equally spaced. These ports are drilled holes and are each approximately 1/16 inch in diameter. FIG. 1(*b*) is a side cutaway view of the injector (10), showing a converging-diverging passageway (12) for the inert gas and passageways (13) that can be used for fuel or a mixture of fuel and oxygen.

The argon was injected at 100 psig and 3795 scfh and the fuel was natural gas (NG). The nozzle exit (D) and throat (T) diameters were 0.38-in. and 0.26-in., respectively. In a simulated furnace gas, the internal injection of fuel resulted in no change in jet length, as shown in Table 1.

TABLE 1

Argon With Internal Injection of Fuel

| P.H. $O_2$ (scfh) | P.H. CO (scfh) | CO Flow (scfh) | Inj. NG (scfh) | T.C. Exit (° F.) | T.C. Mid (° F.) | Jet Length (in.) | % NG/ MAIN | L/Lo |
|---|---|---|---|---|---|---|---|---|
| 1248 | 650 | 5131 | 0.00 | 1892 | 1792 | 10.25 | 0.00 | 1.00 |
| 1248 | 650 | 5131 | 35.20 | NT | NT | 10.50 | 0.93 | 1.02 |
| 1248 | 650 | 5131 | 58.10 | 1868 | 1789 | 10.25 | 1.53 | 1.00 |
| 1248 | 650 | 5131 | 80.60 | 1869 | 1783 | 10.25 | 2.12 | 1.00 |
| 1248 | 650 | 5131 | 103.10 | 1867 | 1797 | 10.00 | 2.72 | 0.98 |

P.H. O2 = Preheat burner $O_2$
P.H. CO = Preheat burner CO
Inj. NG = Injection of natural gas
T.C. Exit = Temperature of simulated furnace gas at exit (Position 27, FIG. 2)
T.C. Mid = Temperature of simulated furnace gas at midpoint (Position 26, FIG. 2)
Jet Length = Length of argon coherent jet outside of injector
% NG/MAIN = 100 * (scfh NG/scfh Argon)
L/Lo = Ratio of jet length of argon with fuel injection only to jet length of argon without injection of fuel The coherent jet length is defined as the axial centerline distance from the nozzle exit to where a Pitot tube registers 50 psig, which corresponds to a position within the supersonic core of about Mach 1.7.

The experimentally measured temperatures above, when corrected for radiation losses, result in actual simulated furnace gas temperatures near to commercial furnaces, in the range of about 3000° F.

EXAMPLE 2

Argon Coherent Jets with Oxygen and Fuel

In this set of experiments, the same injector design as in Example 1 was used and both oxygen and fuel were premixed and injected via the passageways 13 into the internal shroud ports to try to produce a coherent argon jet. However, injecting only internal oxygen (up to 2% relative to the argon flow) and injecting both fuel (0.66%) and oxygen (0.97%) resulted in no changes in jet length (i.e., L/Lo=.about.1 for all experiments), as shown in Table 2.

TABLE 2

Argon With Internal Injection of Oxygen and Fuel

| P.H. $O_2$ (scfh) | P.H. CO (scfh) | CO Flow (scfh) | Inj. NG (scfh) | Inj. $O_2$ (scfh) | T.C. Exit (° F.) | T.C. Mid (° F.) | Jet Length (in.) | % NG/ MAIN | % $O_2$/ MAIN | L/Lo |
|---|---|---|---|---|---|---|---|---|---|---|
| 1164 | 660 | 5131 | 0.00 | 0.00 | 1896 | 1812 | 9.88 | 0.00 | 0.00 | 1.00 |
| 1164 | 660 | 5131 | 0.00 | 37.90 | NT | NT | 10.00 | 0.00 | 1.00 | 1.01 |
| 1164 | 660 | 5131 | 0.00 | 71.40 | 1868 | 1824 | 10.00 | 0.00 | 1.88 | 1.01 |
| 1164 | 660 | 5131 | 80.60 | 0.00 | NT | NT | 10.00 | 0.78 | 0.00 | 1.01 |
| 1164 | 660 | 5131 | 103.10 | 36.80 | NT | NT | 10.00 | 0.66 | 0.97 | 1.01 |

P.H. O2 = Preheat burner $O_2$
P.H. CO = Preheat burner CO
Inj. NG = Injection of natural gas
T.C. Exit = Temperature of simulated furnace gas at exit (Position 27, FIG. 2)
T.C. Mid = Temperature of simulated furnace gas at midpoint (Position 26, FIG. 2)
Jet Length = Length of argon coherent jet outside of injector
% NG/MAIN = 100 * (scfh NG/scfh Ar)
% $O_2$/MAIN = 100 * (scfh $O_2$/scfh Ar)
L/Lo = Ratio of jet length of argon with fuel injection only to jet length of argon without injection of fuel

EXAMPLE 3

Injector with Porous Metal Distributor

Figure 3:
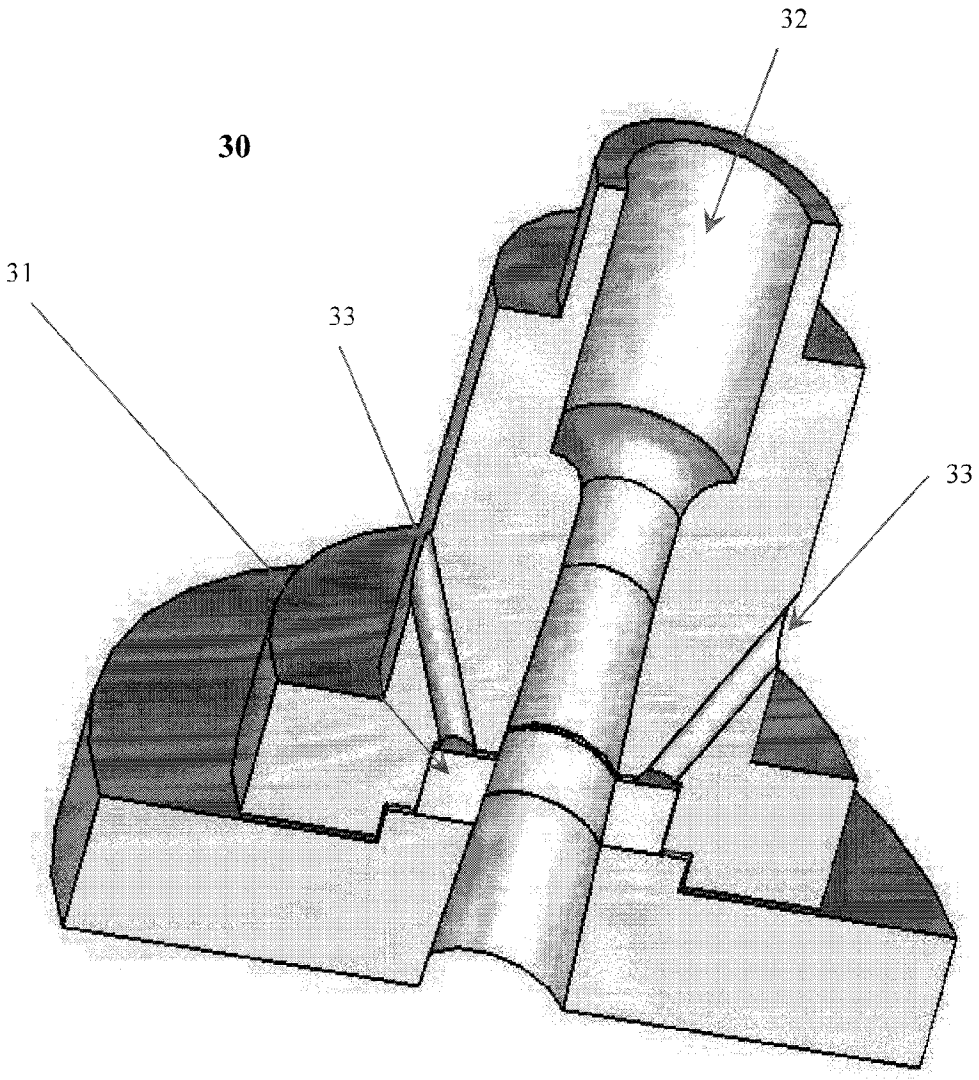
FIG. 3 is a schematic, cross-sectional view of an injector used to inject a jet of inert gas at a supersonic velocity into a melt for use in accordance with the method of the present invention.

Further experiments were run using the injector shown in FIG. 3. This injector (30) used a single porous metal (31), typically brass or bronze or copper, but any metal can be used, to evenly distribute a "pre-mixed" mixture of fuel and oxygen as the internal shroud gas into argon/oxygen main jets of varying compositions, including pure argon. The injector (30) comprises a converging/diverging passageway for the inert gas (32) and additional passageways (33) for fuel and oxygen to form the internal shroud. These experiments were conducted as single nozzle experiments and the converging/diverging passageway was designed to allow for oxygen flow at 4000 scfh (100 psig, Mach 2). In the experiments, the argon and oxygen were flowed between 3775-4000 scfh at 100 psig. The temperature at which the experiments were run was approximately 2250° F. (not corrected for radiation losses).

Figure 4:
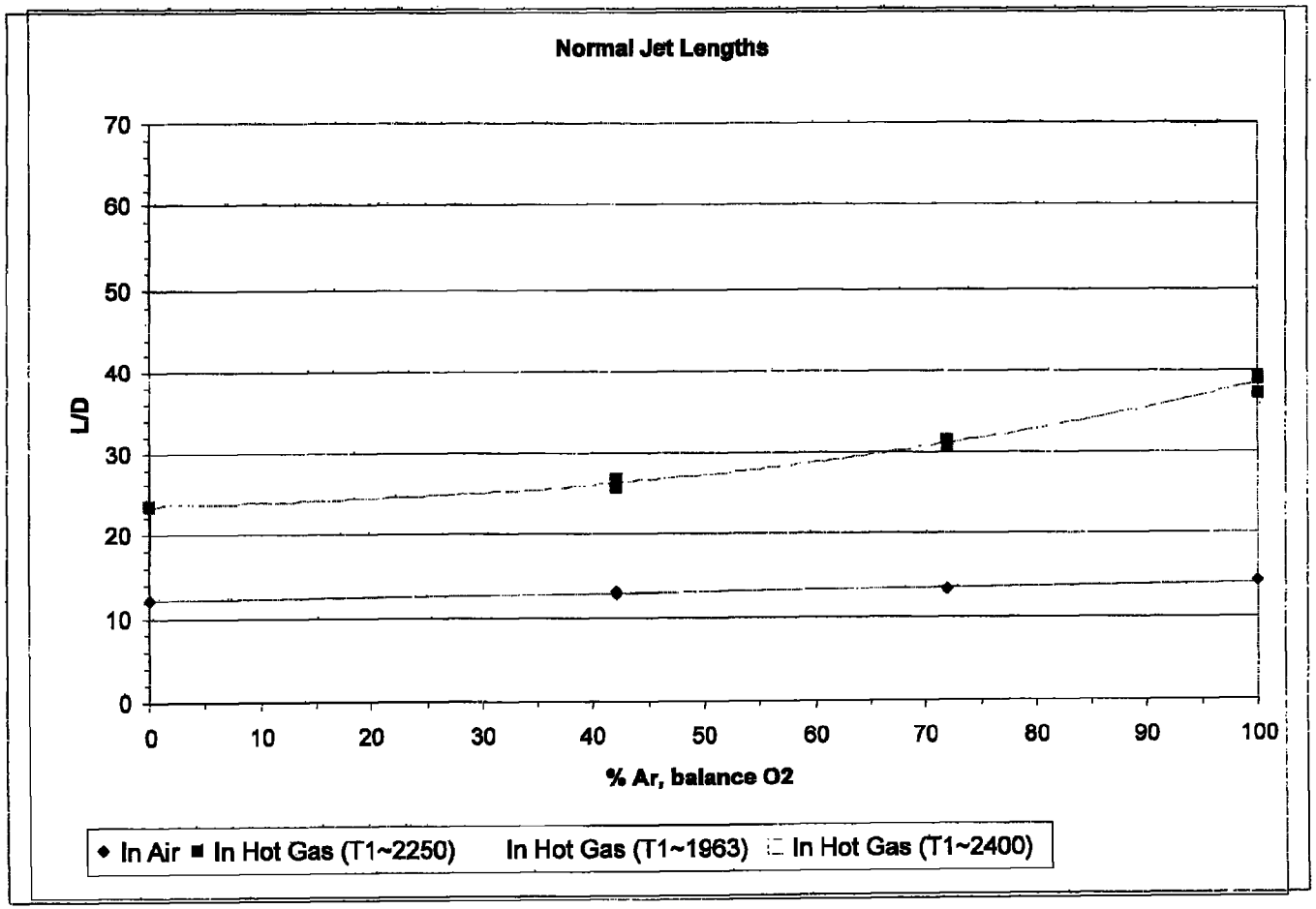
FIG. 4 is a graphical representation of the normalized coherent jet length (L/D) versus the normal jet length in the simulated furnace gas without introducing internal shroud gas.

FIG. 4 is a graphical representation of the normalized jet length (length/diameter=L/D) in the simulated furnace gas as a function of argon concentration, balance oxygen, without introducing internal shroud gas. The values taken in ambient air are also shown.

Figure 5:
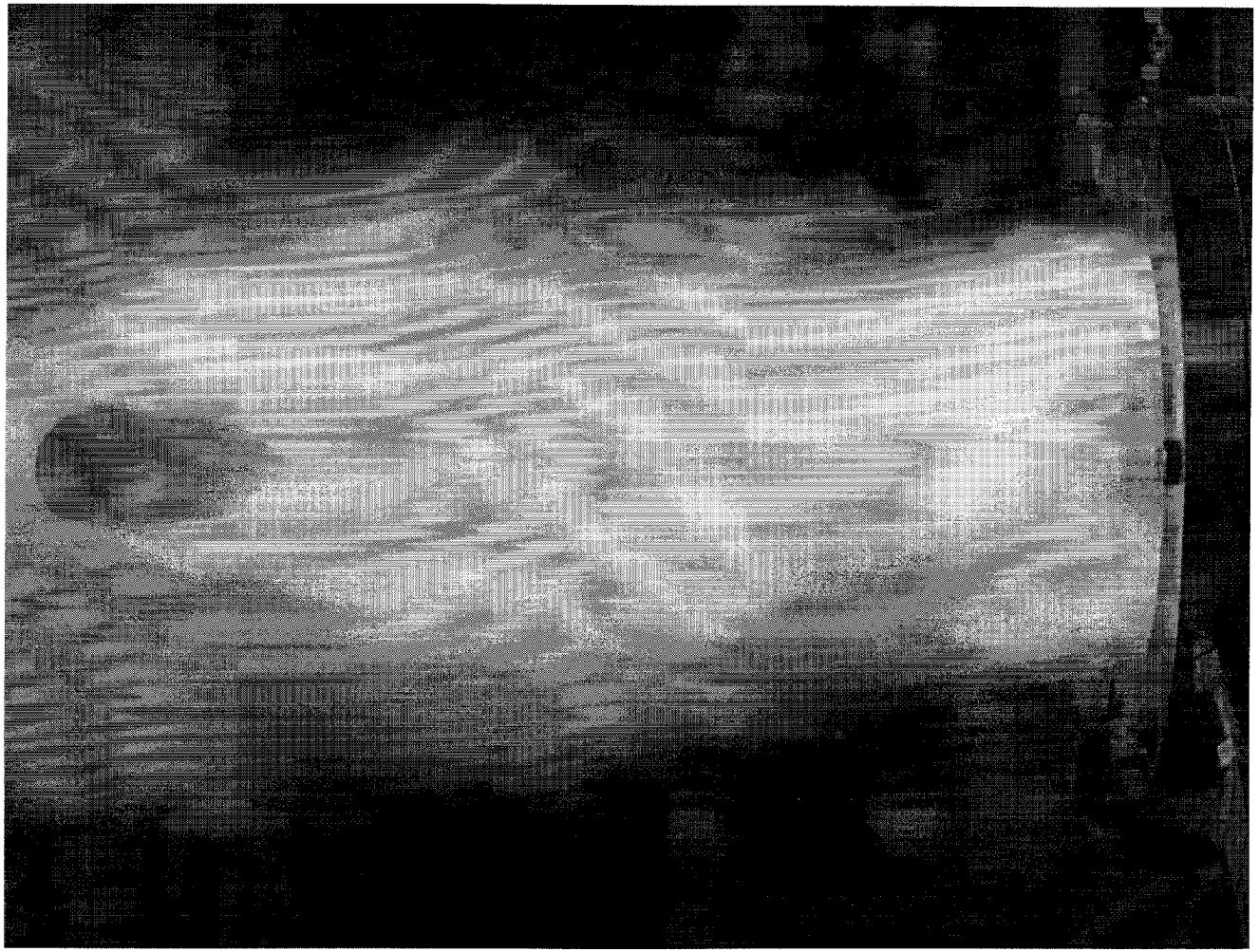
FIG. 5 is a photograph of the experimental apparatus operating with a pure Mach 2 argon jet with no internal shroud gas.

FIG. 5 is a photograph of the experimental apparatus operating with a pure Mach 2 argon jet with no internal shroud gas. The argon jet is invisible and in this experiment produced a L/D of about 38.

Figure 6:
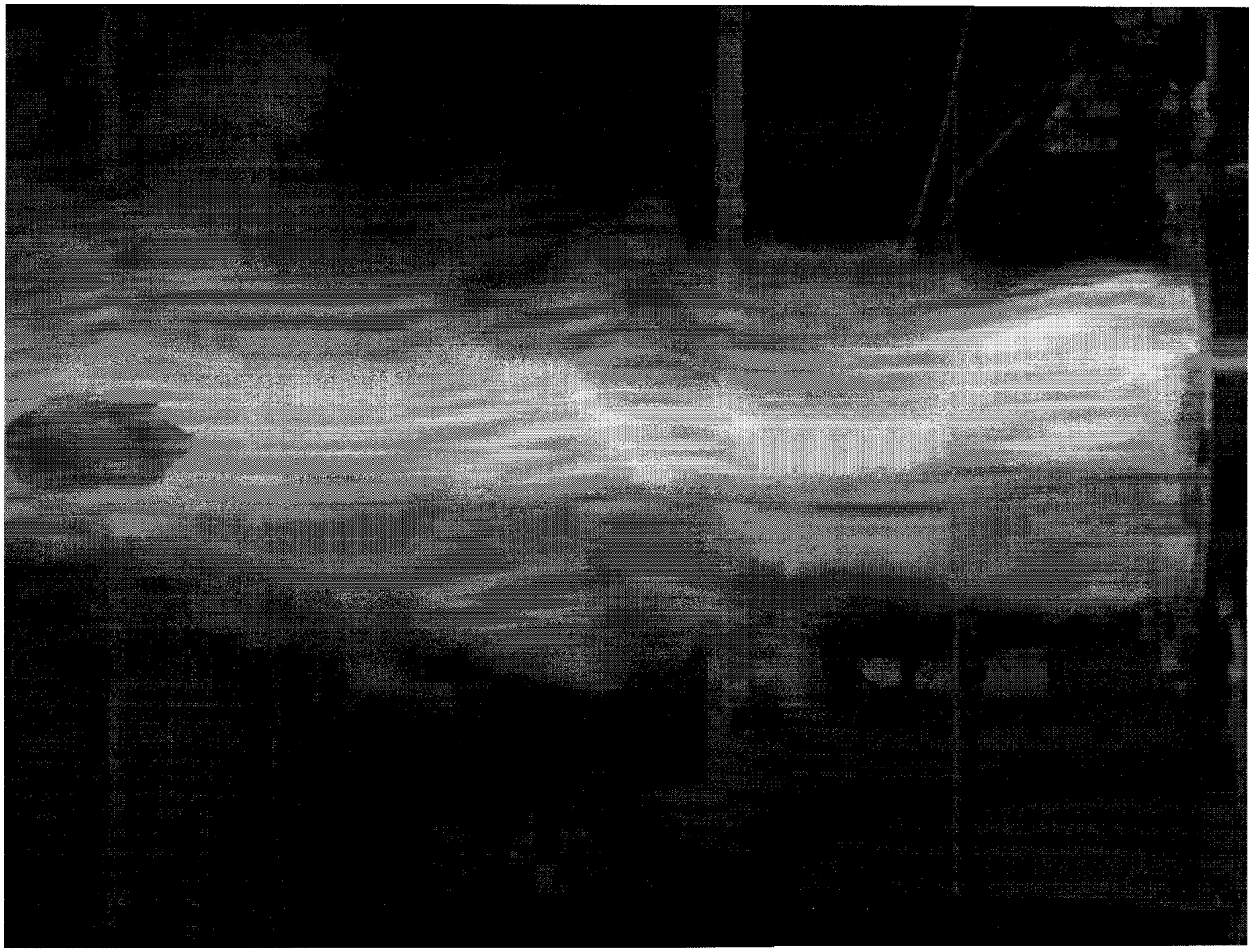
FIG. 6 is a photograph of a Mach 2 argon jet under the conditions of the invention.

FIG. 6 is a photograph of a Mach 2 argon jet under the conditions of the invention. The internal shroud oxygen was admitted at about 13% and the internal methane was admitted at about 3% of the initial main argon flow. The jet is now visible because of the reaction of fuel, oxygen and carbon monoxide from the simulated furnace gas. The jet length increased to L/D=60.

Figure 7:
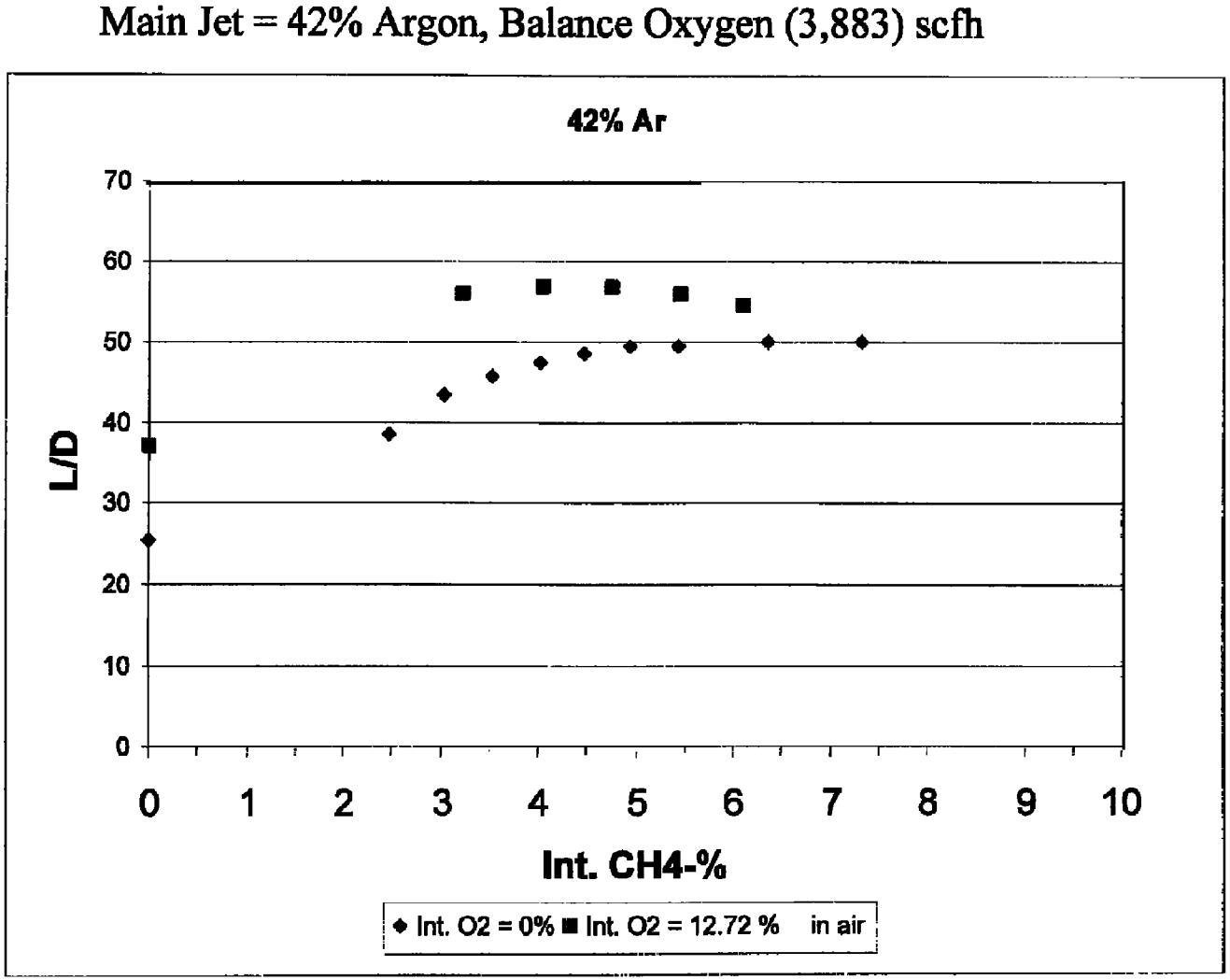
FIG. 7 is a graphical representation of the internal shroud effect on a Mach 2 main jet with initial composition of 42% argon, balance oxygen.

FIG. 7 is a graphical representation of the internal shroud effect on a main jet with initial composition of 42% argon, balance oxygen. Jet length L/D is plotted against the internal shroud fuel rate, for different internal oxygen rates. In this case, the amount of oxygen initially present in the main jet allows the internal fuel injection to be effective. However, by adding internal shroud oxygen, the jet lengths are substantially improved relative to adding only fuel.

Figure 8:
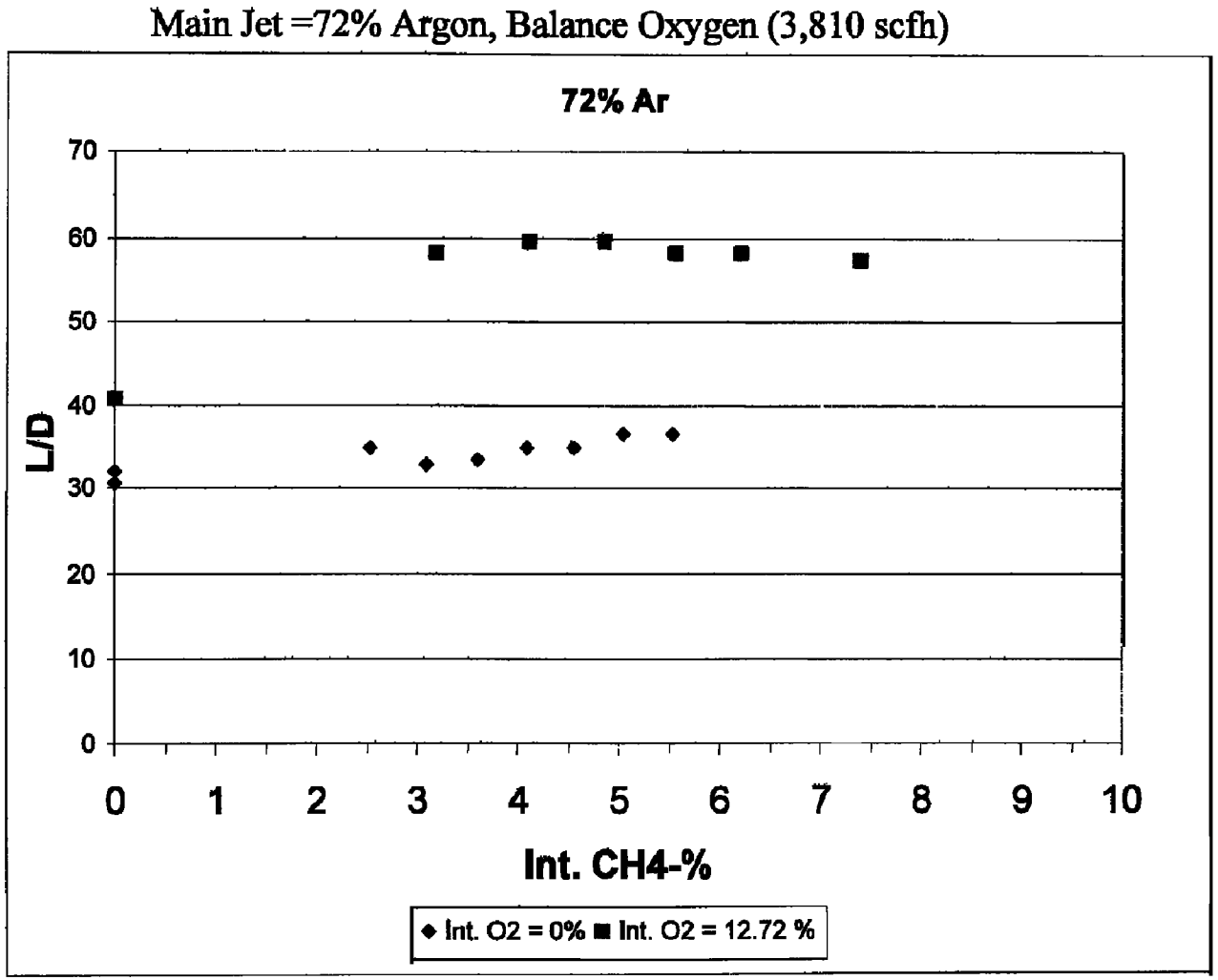
FIG. 8 is a graphical representation of the internal shroud effect on a Mach 2 main jet with initial composition of 72% argon.

FIG. 8 is a graphical representation of the internal shroud effect on a main jet with initial composition of 72% argon. Jet length L/D is plotted against the internal shroud fuel rate, for different internal oxygen rates. In this case, the amount of oxygen initially present in the main jet was not sufficient to allow the internal fuel injection process effective. However, adding internal shroud oxygen allowed the jet lengths to increase substantially from the initial condition.

Figure 9:
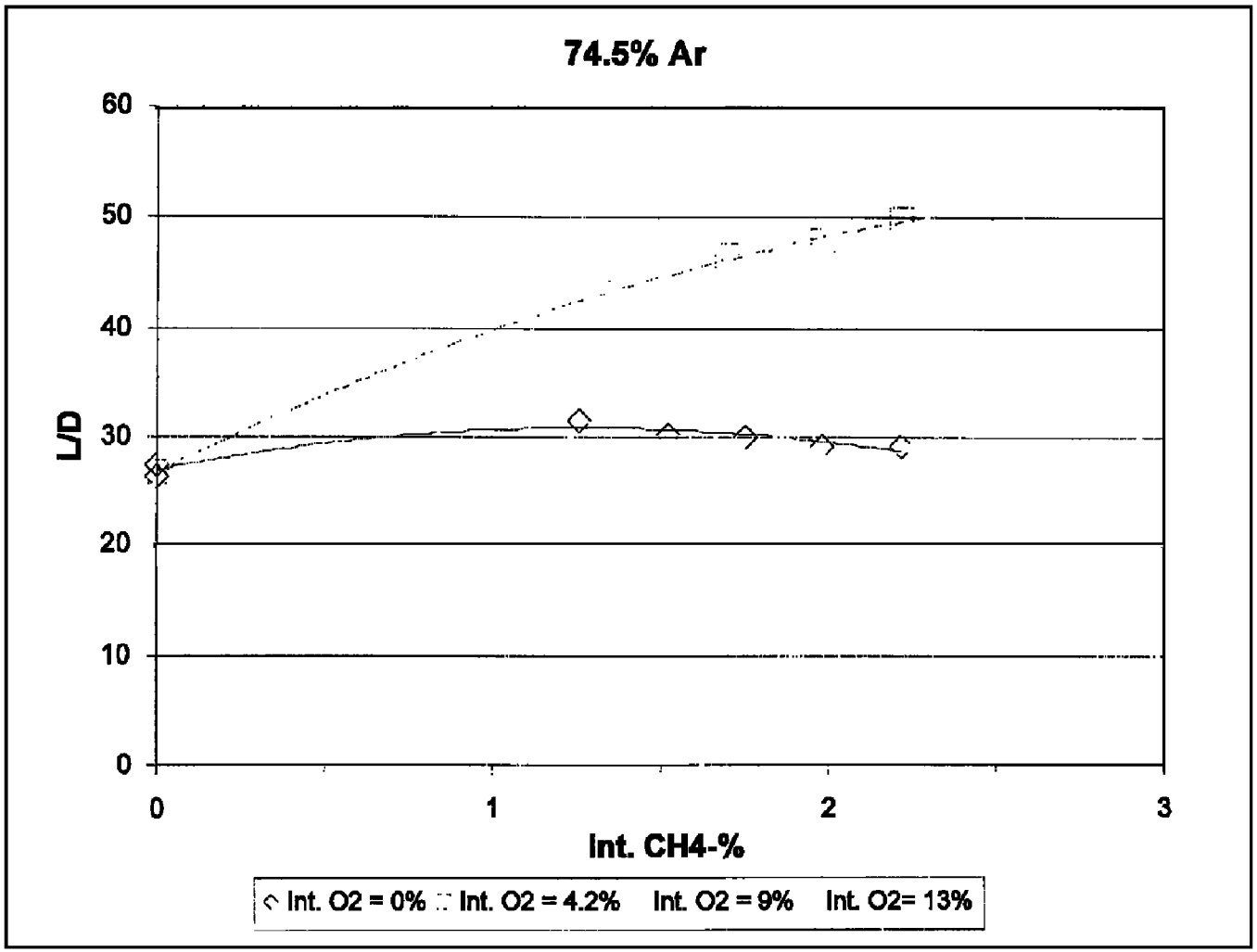
FIG. 9 is a graphical representation for a Mach 2 main jet initially containing 74.5% argon.
Figure 10:
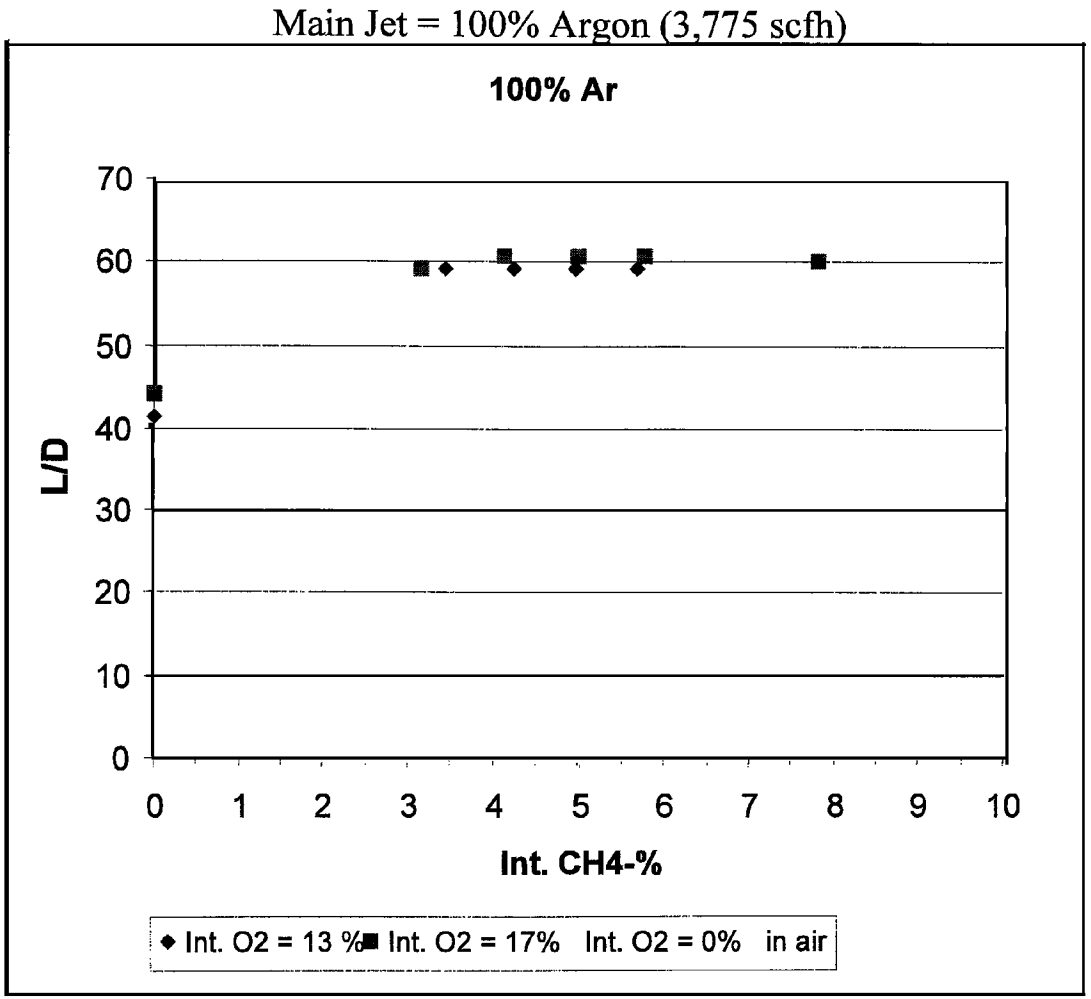
FIGS. 10, 11 and 12 are graphical representations for a Mach 2 main jet initially containing pure argon.
Figure 11:
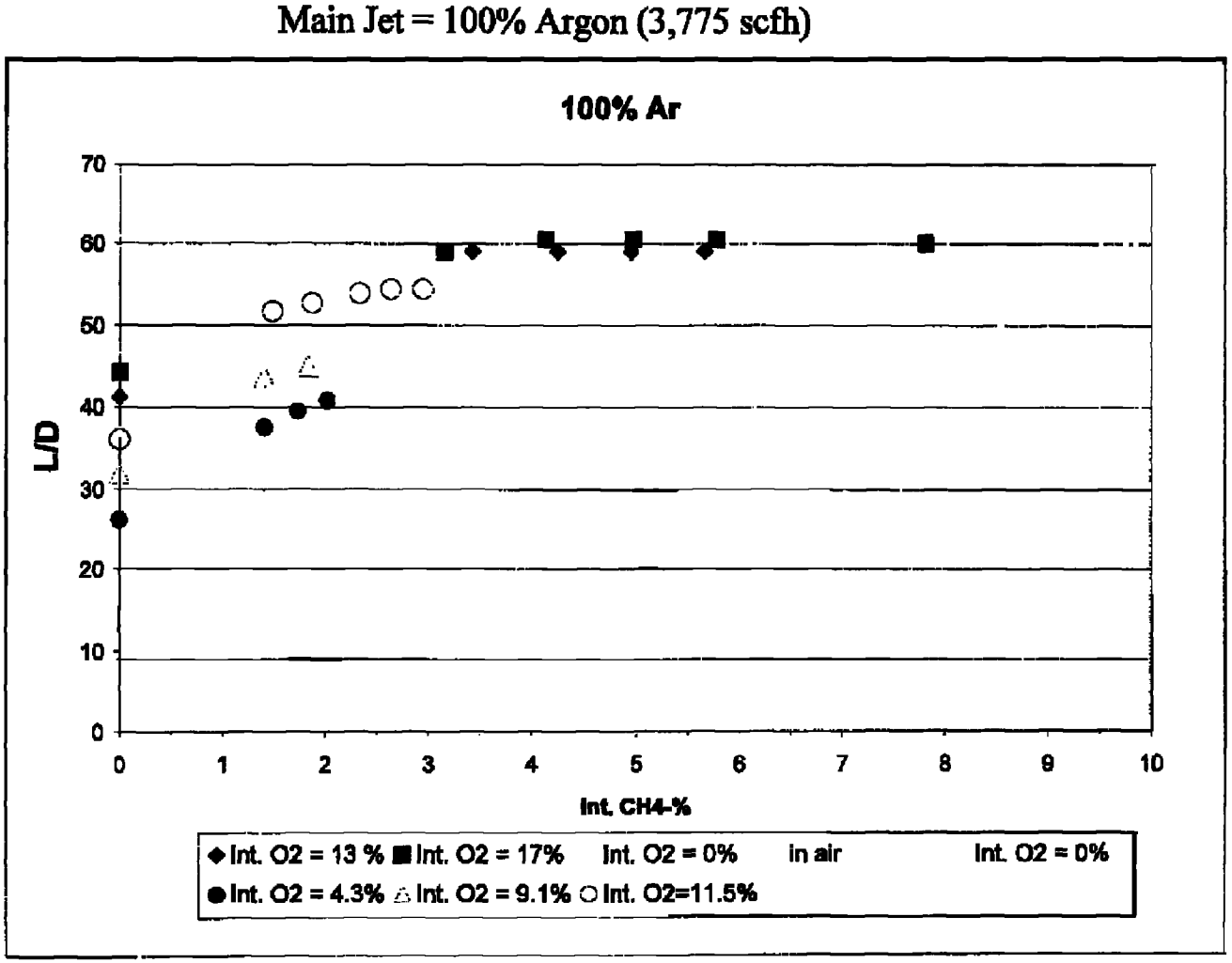
Figure 12:
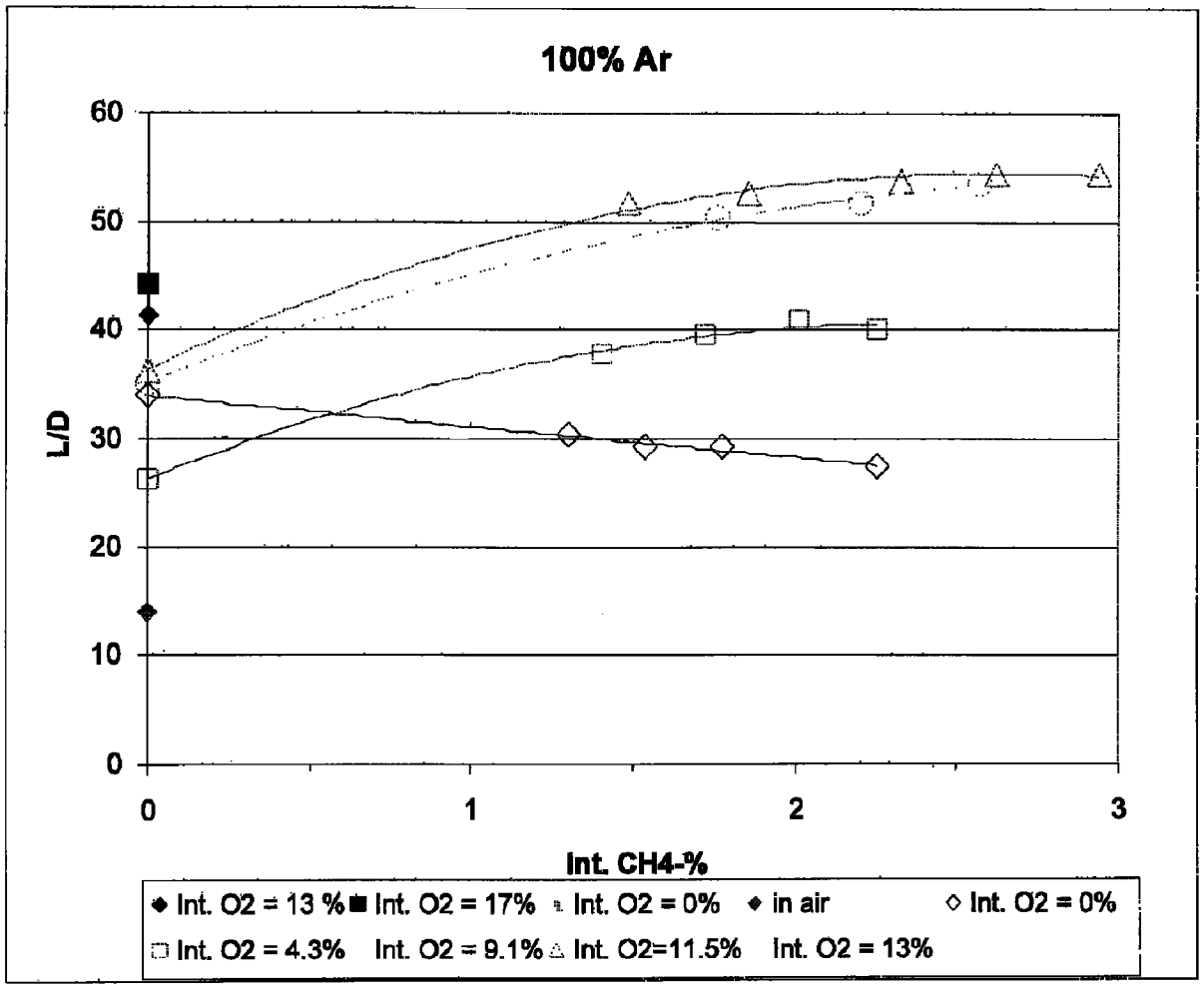

FIG. 9 is a graphical representation for main jet initially containing 74.5% argon. FIGS. 10, 11 and 12 are graphical representations for a main jet initially containing pure argon. In all of these cases, adding only fuel resulted in a decrease in jet length. However, adding both fuel and oxygen allowed the production of long coherent jets.

Figure 13A:
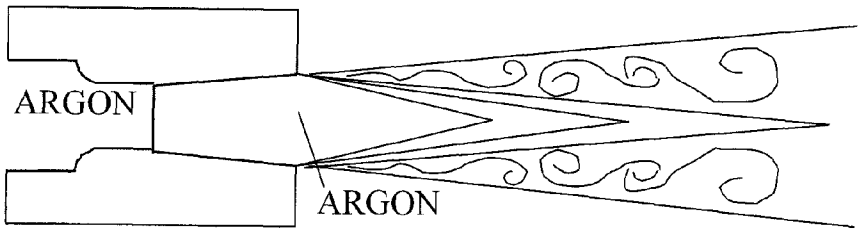
FIGS. 13(*a*) and 13(*b*) are schematic, cross-sectional views showing an injector for an argon jet without an internal shroud of the present invention and an injector for an argon jet with an internal shroud of the present invention, respectively.
Figure 13B:
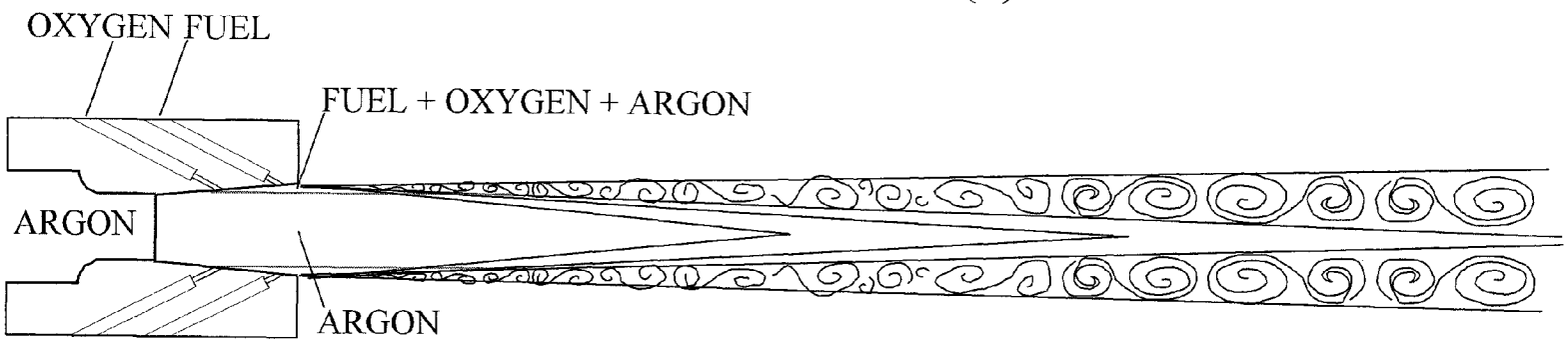

Another such embodiment that uses two separate conduits to supply the shroud fuel and oxygen is shown in FIG. 13(*b*). This embodiment utilizes two porous bands to supply the fuel and oxygen separately. The porous metal is fabricated as part of the nozzle diverging section. Most likely, the fuel would be delivered in the lower band where the nozzle fluid is at a lower pressure. As compared with an argon only jet with no internal shroud, as shown in FIG. 13(*a*), the internal shroud provides a longer supersonic core, resulting in a longer coherent jet. The concept of forming a compositionally "structured" jet applies to the formation of argon coherent jets with the internal shroud technique. Composition measurements were taken under the conditions of this invention and provided insight into the mixing and reaction of the fuel and oxygen injection process into a pure argon jet designed for Mach 2.

Figure 14:
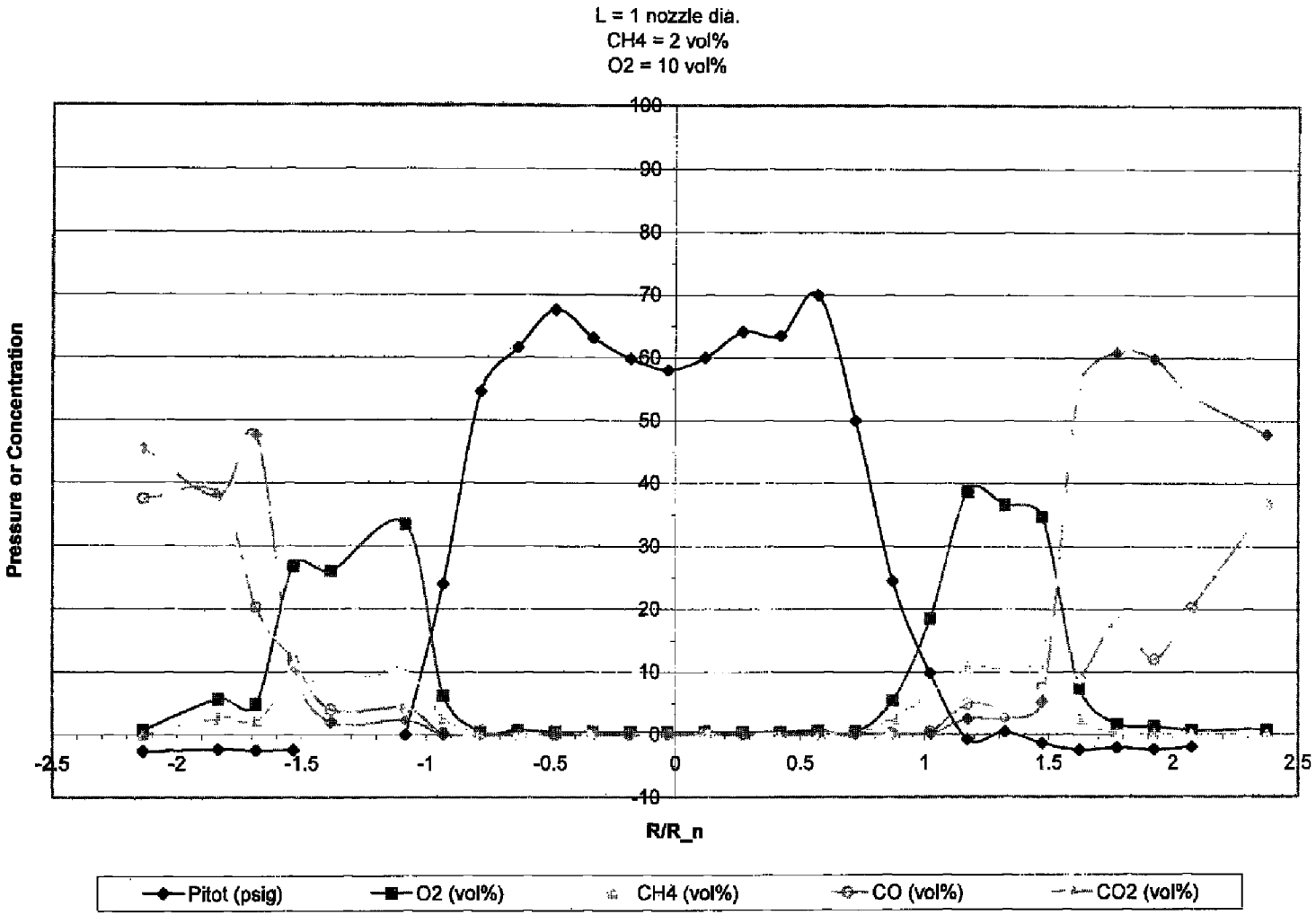
FIG. 14 is a graphical representation of a radial Pitot pressure and composition profile for a 100% argon jet with about 10% internal oxygen (relative to argon flow) and about 2% internal methane (relative to argon flow) during the operation of this invention.

FIG. 14 shows a radial Pitot pressure and composition profile for a 100% argon jet with about 10% internal oxygen and about 2% internal methane during the operation of this invention. The measurements were taken at an axial position of about 1 nozzle diameter from the nozzle exit plane. The design used to obtain this data is shown in FIG. 3.

The data plot in FIG. 14 shows the "structure" of the internal shroud argon jet operating in a simulated furnace gas. The plot contains Pitot-tube pressure (psig) and gas composition (vol %) as a function of the radial position. Oxygen, methane, carbon monoxide, carbon dioxide were the only gases analyzed; argon could not be measured.

The central core of the jet consists of very high velocity pure argon. At the outer circumferential region, the gas contains oxygen, methane and argon; the gas is not burning within the nozzle as determined by the lack of detection of combustion products in the range of −1 to 1 ($-1<R/R_n<1$). At about $-1.5 \leqq R/R_n \geqq 1.5$, the methane and oxygen peaks precipitously drop due to reaction with the furnace atmosphere to produce carbon dioxide and carbon monoxide. This position marks the location of the inner edge of the flame front. R is the radial coordinate and $R_n$ is the nozzle exit radius ($R_n=D/2$)

Although the invention has been described in detail with reference to certain preferred embodiments, those skilled in the art will recognize that these are other embodiments within the spirit and the scope of the claims.

We claim:

1. A method of injecting inert gas into melt located within a metallurgical furnace having a heated furnace atmosphere, said method comprising:

(a) introducing an inert gas stream into a nozzle having a passageway of converging-diverging configuration;

(b) forming a combined fuel, inert gas and oxygen-containing stream by (b.1) injecting an oxygen stream into the inert gas stream at inner circumferential locations of the passageway that are situated entirely within the passageway so that a combined inert gas and oxygen-containing stream is formed with the passageway, and injecting a fuel containing a hydrogen species into the inert gas stream at inner circumferential locations of the passageway that are situated entirely within the passageway, or (b.2) injecting a pre-mixed stream of oxygen and a fuel containing a hydrogen species into the inert gas stream at inner circumferential locations of the passageway that are situated entirely within the passageway;

(c) so that a combined fuel, inert gas and oxygen-containing stream is formed within the passageway having a structure composed of an outer circumferential region containing a mixture of the inert gas, the oxygen and the fuel and an inner central region surrounded by the outer circumferential region and containing the inert gas and essentially no fuel or oxygen;

(d) the inert gas stream being introduced into an inlet section of the passageway at or above a critical pressure, thereby to produce: a choked flow condition within the central throat section of the passageway; acceleration of the combined fuel, inert gas and oxygen-containing stream to a supersonic velocity within a diverging section of the passageway; and discharge of the combined fuel, inert gas and oxygen-containing stream as a structured jet from the nozzle into the furnace atmosphere, the structured jet having the structure of the combined fuel, inert gas and oxygen-containing stream and the supersonic velocity upon discharge from the nozzle;

(e) preventing ignition and combustion of the fuel within the passageway by providing the passageway with an inner surface uninterrupted by any discontinuity within which the outer circumferential region could otherwise decelerate and provide a site for stable combustion of the fuel;

(f) producing a flame envelope surrounding a jet of inert gas formed from the inner central region of the structured jet and initially having the supersonic velocity to inhibit velocity decay and concentration decay of the jet of inert gas, the flame envelope being produced entirely outside of the nozzle through contact of the outer circumferential region of the structured jet with the heated furnace atmosphere so as to create a shear-mixing zone containing a flammable mixture composed of the fuel, the inert gas, the oxygen and the heated furnace atmosphere and auto-ignition of the flammable mixture through heat supplied by the heated furnace atmosphere; and (g) directing the jet of inert gas into the melt, while surrounded by the flame envelope.

2. The method of claim 1, wherein:

the combined fuel, inert gas and oxygen-containing stream is fully expanded upon discharge thereof as the structured jet from the nozzle; and either (A.1) the combined fuel, inert gas and oxygen-containing stream is formed by step (b.1), and the oxygen is introduced to the inert gas stream while within the diverging section of the nozzle; and (A.2) the fuel is introduced to the inert gas stream while within the diverging section of the nozzle; or (B.1) the combined fuel, inert gas and oxygen-containing stream is formed by step (b.2); and (B.2) the combined fuel, inert gas and oxygen-containing stream is fully expanded upon discharge thereof as the structured jet from the nozzle; and (B.3) the pre-mixed fuel and oxygen stream is introduced to the inert gas stream while within the diverging section of the nozzle.

3. The method of claim 1, wherein:

the combined fuel, inert gas and oxygen-containing stream is over expanded upon the discharge thereof as the structured jet from the nozzle such that the inert gas stream has a sub-ambient pressure while within the diverging section of the nozzle; and either (A) the combined fuel, inert gas and oxygen-containing stream is formed by step (b.1), and the fuel is introduced to the inert gas stream at a location within the diverging section at which the inert gas stream is at a sub-ambient pressure; or (B) the combined fuel, inert gas and oxygen-containing stream is formed by step (b.2) and the pre-mixed fuel and oxygen stream is introduced to the inert gas stream at a location within the diverging section at which the inert gas stream is at a sub-ambient pressure.

4. The method of claim 1, wherein the metallurgical furnace is an electric arc furnace or a basic oxygen furnace, the heated furnace atmosphere contains carbon monoxide and the flammable mixture contains the carbon monoxide.

5. The method of claim 1, wherein the fuel is introduced into the inert gas stream at the inner circumferential locations of the passageway by injecting the fuel into a porous metal annular element having an inner annular surface forming part of the throat section or the diverging section of the converging-diverging passageway.

6. The method of claim 1, wherein the inert gas is argon.

7. A method of injecting inert gas into melt located within a metallurgical furnace having a heated furnace atmosphere containing carbon monoxide, said method comprising:

(a) introducing inert gas streams into nozzles having passageways of converging-diverging configuration, the nozzles being situated at a tip of a water-cooled lance and angled outwardly from a central axis of the water-cooled lance;

(b) injecting oxygen streams into the inert gas streams at inner circumferential locations of the passageways that are situated entirely within the passageways so that combined inert gas and oxygen-containing streams are formed with the passageways;

(c) injecting a fuel containing a hydrogen species into the inert gas streams at inner circumferential locations of the passageways that are situated entirely within the passageways so that combined fuel, inert gas and oxygen-containing streams are formed within the passageways, each having a structure composed of an outer circumferential region containing a mixture of the inert gas, the oxygen and the fuel and an inner central region surrounded by the outer circumferential region and containing the inert gas and essentially no fuel or oxygen;

(d) the inert gas streams being introduced into inlet sections of the passageways at or above a critical pressure, thereby to produce: a choked flow condition within the central throat sections of the passageways; acceleration of the combined fuel, inert gas and oxygen-containing stream to a supersonic velocity within diverging sections of the passageways; and discharge of the combined fuel, inert gas and oxygen-containing streams as structured jets from the nozzles into the furnace atmosphere, the structured jets having the structure of the combined fuel, inert gas and oxygen-containing streams and the supersonic velocity upon discharge from the nozzle;

(e) preventing ignition and combustion of the fuel within the passageways by providing the passageways with an inner surface uninterrupted by any discontinuity within which the outer circumferential region could otherwise decelerate and provide a site for stable combustion of the fuel;

(f) producing flame envelopes surrounding individual jets of inert gas formed from the inner central region of the structured jets and initially having the supersonic velocity to inhibit velocity decay and concentration decay of the jets of inert gas, the flame envelopes being produced entirely outside of the nozzles through contact of the outer circumferential region of the structured jets with the heated furnace atmosphere so as to create a shear-mixing zone containing a flammable mixture composed of the fuel, the inert gas, the oxygen and the heated furnace atmosphere and auto-ignition of the flammable mixture through heat supplied by the heated furnace atmosphere; and (g) situating the water-cooled lance within the metallurgical vessel and directing the jets of inert gas into the melt, while surrounded by the flame envelopes.

8. The method of claim 7, wherein the inert gas is argon.

9. The method of claim 7, wherein:

the fuel is introduced into a fuel chamber and the nozzles pass through the fuel chamber; and the fuel is introduced into the passageways through fuel passages located within the lance tip and communicating between the inner circumferential locations of the passageways and the fuel chamber.

10. An apparatus comprising:

(a) an injector or lance with lance body and lance tip;

(b) at least one means for introducing an inert gas, oxygen and a hydrogen-containing fuel into the lance body;

the lance tip containing one or more converging-diverging nozzles for the production of one or more supersonic inert gas streams having an outer perimeter;

(d) at least one means for evenly distributing a mixture of hydrogen-containing fuel and oxygen; and (e) at least one means composed of a porous metal for injecting a mixture of fuel and oxygen into the outer perimeter of one or more supersonic inert gas streams produced by said one or more converging-diverging nozzles, into any section of the nozzle.

* * * * *